US005390927A

United States Patent [19]

Angelos

[11] Patent Number: 5,390,927

[45] Date of Patent: Feb. 21, 1995

[54] GOLF SIMULATOR HAVING SYSTEM FOR CALCULATING SLICE/HOOK COMPONENT OF BALL TRAJECTORY

[76] Inventor: Arthur C. Angelos, 501 Slaters La., #1109, Alexandria, Va. 22314

[21] Appl. No.: 187,077

[22] Filed: Jan. 27, 1994

[51] Int. Cl.[6] ..... A63B 69/36

[52] U.S. Cl. ..... 273/185 A; 273/185 B; 273/184 R; 273/185 R; 273/181 R; 434/252

[58] Field of Search ..... 273/185 A, 185 B, 185 R, 273/35 R, 85 G, 176 R, 181 R, 184 R, 186.1; 434/252

[56] References Cited

U.S. PATENT DOCUMENTS

| | | | |
|---|---|---|---|
| 2,783,999 | 3/1957 | Simjian . | |
| 2,784,000 | 3/1957 | Simjian . | |
| 3,020,049 | 2/1962 | McNeill . | |
| 3,072,410 | 1/1963 | Simjian . | |
| 3,160,011 | 12/1964 | Ogden . | |
| 3,194,563 | 7/1965 | MacKniesh . | |
| 3,452,990 | 7/1969 | Nichols . | |
| 3,559,996 | 2/1971 | Hopp . | |
| 3,591,184 | 7/1971 | Conklin et al. . | |
| 3,601,408 | 8/1971 | Wright . | |
| 3,729,315 | 4/1973 | Conklin et al. . | |
| 3,778,064 | 12/1973 | Nutter . | |
| 3,837,655 | 9/1974 | Angelos . | |
| 3,892,414 | 7/1975 | Glasson et al. . | |
| 4,086,630 | 4/1978 | Speiser et al. . | |
| 4,136,387 | 1/1979 | Sullivan et al. . | |
| 4,150,825 | 4/1979 | Wilson | 273/185 B |
| 4,155,555 | 5/1979 | Fink | 273/186 R |
| 4,223,891 | 9/1980 | Van Gaasbeek et al. . | |
| 4,254,956 | 3/1981 | Rusnak . | |
| 4,327,918 | 5/1982 | Foster . | |
| 4,836,551 | 6/1989 | Lasalle . | |
| 4,858,922 | 8/1989 | Santavaci | 273/185 R |
| 4,872,687 | 10/1989 | Dooley | 273/185 R |
| 5,024,441 | 6/1971 | Rousseau | 273/176 R |
| 5,056,791 | 10/1991 | Poillon et al. | 273/185 B |
| 5,171,012 | 12/1992 | Dooley | 273/85 G |
| 5,171,013 | 12/1992 | Dooley | 273/85 G |
| 5,209,843 | 5/1993 | Gedney et al. | 273/187.4 |
| 5,226,660 | 7/1993 | Curchod | 273/185 B |

FOREIGN PATENT DOCUMENTS

| | | | |
|---|---|---|---|
| 4322672 | 11/1992 | Japan | 273/185 B |
| 1541703 | 3/1979 | United Kingdom . | |
| 2091111 | 7/1982 | United Kingdom . | |

*Primary Examiner*—Vincent Millin
*Assistant Examiner*—Kerry Owens
*Attorney, Agent, or Firm*—Oliff & Berridge

[57] ABSTRACT

A golf simulator includes a target screen that receives a projected image of a golf hole from a player's view. As a player hits a ball into the target screen, a main controller analyzes the swing and displays the path of the golf ball using a spotlight generated by a tracer. A slice/-hook determining apparatus includes a clubhead impact angle sensor for determining the clubhead impact angle at impact with the ball. A controller in the slice/hook determining apparatus calculates a theoretical impact point where the ball would hit the impact screen if no side spin were imparted on the ball. The main controller compares the theoretical impact point with the actual impact point and accurately determines a slice/hook component of the ball trajectory based on the difference between the actual impact point and the theoretical input point.

28 Claims, 5 Drawing Sheets

GOLF SIMULATOR HAVING SYSTEM FOR CALCULATING SLICE/HOOK COMPONENT OF BALL TRAJECTORY

BACKGROUND OF THE INVENTION

This invention relates to a golf simulator that calculates and displays a simulated ball trajectory from an actual ball struck from a hitting area into a target screen and, more particularly, to such an apparatus having a system for determining a slice/hook component of the ball trajectory.

Several prior art devices exist for determining the amount of hook or slice imparted to a golf ball in an indoor golf playing system. These devices, however, have not been completely satisfactory in that they have been complicated in construction and expensive to manufacture, have required complex screen arrangements, have not been completely accurate or reliable in operation, and have required extensive maintenance.

In one such device, a spherical shell or screen is used and the tee for the golf ball is positioned at the center of the sphere. If the golf ball is hit without side spin, it will hit the screen and rebound therefrom to the center of the sphere. If however, a side spin is imparted to the ball, it will not return to the center of the sphere. By measuring or indicating the point to which the ball returns, the amount of spin (hook or slice) can be determined. This type of system is subject to certain disadvantages. If the ball must roll back toward the center of the sphere before its rebound position is indicated, it is subject to inaccuracies caused by the floor surface not being completely level, which may affect the roll and/or bounce of the ball. Furthermore, the construction of a perfectly spherical screen is difficult and expensive.

Another type of device uses two impact surfaces or screens positioned at an angle relative to each other. The ball is hit into one of the screens and bounces off of that screen onto the second screen. The points at which the ball strikes the first and second screens are detected to indicate the amount of spin imparted to the ball. The geometry of the two screens is such that if a ball having no side spin strikes the first screen at a first point, it will strike the second screen at a predetermined second point. If, however, side spin is imparted to the ball, it will strike the second screen at a point other than the predetermined second point, and the difference between the actual second point of contact and the predetermined point is used to determine and indicate the amount of hook or slice. This system has the obvious disadvantage that it requires two accurately positioned and constructed screens rather than a single screen. This is critical not only because of the additional expense of a second screen, but also because of the additional space required for the second screen. Space, of course, is at a premium in an indoor golf playing system. Also, the second screen may adversely affect, from the standpoint of appearance, the simulation of actual golf course playing conditions.

A third type of apparatus uses a single screen wound on two cylinders such that, as it is wrapped around one cylinder, it unwraps from the other cylinder. If a ball having a side spin is hit into the screen, it will move the screen laterally in a direction corresponding to the direction of the spin and in an amount corresponding to the amount of spin. By detecting the amount of screen that is unwrapped from one cylinder and wrapped around the other cylinder, owing to the impact of the spinning golf ball, the amount of spin and thus the amount of slice or hook can be determined and indicated. This type of apparatus has the disadvantage of being expensive and complicated in construction in that it requires two cylinders and the mechanism associated therewith for wrapping and unwrapping the screen. Furthermore, the moving parts in the screen mounting mechanism are subject to wear and thus to mechanical failure, thus requiring extensive maintenance.

In yet another apparatus, the apparatus includes an impact surface such as a wall or screen into which the golf ball is hit. A row of detectors is positioned between the point from which the ball is hit and the surface. After the ball has been hit and prior to striking the surface, it crosses the row of vertically oriented detectors to actuate one or more of them. The ball then rebounds from the surface and crosses back through the row of detectors to actuate one or more of them. In the case of a substantially planar impact surface, if the ball has no spin imparted to it, the angle of incidence of the ball with respect to the impact surface will equal the angle of reflection. Thus, when there is no spin on the ball and it is detected by one or more detectors as it travels toward the surface, there is a corresponding known detector or detectors that should be actuated as the ball rebounds from the surface. If side spin is imparted to the ball, the actual angle of reflection from the surface will differ from the angle of reflection when there is no side spin. Therefore, a ball having side spin will actuate one or more detectors other than the known detector or detectors that would be actuated when there is no side spin. By noting which detector (or detectors) is actuated by the reflected ball having side spin, the amount of hook or slice can be determined. This system is similarly subject to certain disadvantages. In particular, it is expensive to manufacture and resolution is inadequate.

SUMMARY OF THE INVENTION

Accordingly, it is an object of the present invention to provide a golf simulator capable of accurately detecting a slice/hook component of a simulated ball trajectory that overcomes the problems in the prior devices.

It is another object of the present invention to provide a method and apparatus for accurately determining a slice/hook component of a simulated ball trajectory.

These and other objects are achieved by providing a golf simulator having a frame supporting a target screen and including a projector for projecting a course image on the target screen; a tracer for projecting a ball image on the course image on the target screen, the tracer including a device for dynamically illustrating a ball trajectory; and a controller for determining the ball trajectory and for controlling the tracer in accordance with the determined ball trajectory. The controller includes a data processor for determining a simulated golf ball travel distance, a screen impact sensor for sensing the actual impact point on the target screen, and a slice/hook determining device for determining a theoretical impact point on the target screen, wherein the slice/hook component of the ball trajectory is determined in accordance with a comparison between the theoretical impact point and the actual impact point.

The simulator may further include an impact sensor for sensing impact between the clubhead and a golf ball, and wherein the slice/hook determining device may include a clubhead impact angle sensor for sensing an angle of the clubhead at impact with the golf ball. The data processor determines the golf ball travel velocity in accordance with data obtained from the impact sensor and a distance between the golf ball at impact and the target screen. The slice/hook determining device determines the theoretical impact point on the target screen in accordance with data obtained from both the clubhead impact angle sensor and the distance between the golf ball at impact and the target screen.

In addition, the simulator may include a timer for determining a time between impact of the clubhead and the golf ball sensed by the impact sensor and impact of the golf ball and the target screen sensed by the screen impact sensor. The data processor determines the simulated golf ball travel distance also in accordance with data obtained from the timer.

The clubhead impact angle sensor may include a first row of photosensors and a second row of photosensors. The first and second rows are substantially parallel to the target screen and spaced from each other by a predetermined distance. The photosensors are in communication with the data processor, wherein upon interruption of one of the photosensors, data from the photosensors is provided to the slice/hook determining device at predetermined intervals of time for a predetermined period of time, thereby defining a profile of the clubhead path.

The data processing device may determine the slice/hook component of the ball trajectory based on a predetermined spin trajectory that is scaled in accordance with the difference between the theoretical impact point and the actual impact point.

In another aspect of the invention, a controller is provided for determining a golf ball trajectory and for controlling a tracer for illustrating the golf ball trajectory. The controller includes a screen impact sensor for sensing the actual impact point on the target screen; and a slice/hook determining device for determining a theoretical impact point on a target screen, wherein the slice/hook component of the ball trajectory is determined in accordance with a comparison between the theoretical impact point and the actual impact point.

A method of determining a slice/hook component of a golf ball trajectory of a ball displaced by a clubhead from a hitting area to a target screen is also provided.

BRIEF DESCRIPTION OF THE DRAWINGS

These and other aspects and advantages of the present invention will become apparent in the following detailed description of preferred embodiments when taken in conjunction with the accompanying drawings, in which.

DETAILED DESCRIPTION OF PREFERRED EMBODIMENTS

The below-described general golf simulator, with the exception of the slice/hook determining means, is generally known in the art and will not be described in detail. The various details of the simulator elements can be found in, for example, U.S. Pat. Nos. 5,056,791, 4,836,551 and 4,086,630, the disclosures of which are hereby incorporated by reference. Those of ordinary skill in the art will contemplate various alternatives for the general arrangement of the golf simulator, and the invention is not meant to be limited to the description that follows.

Figure 1:
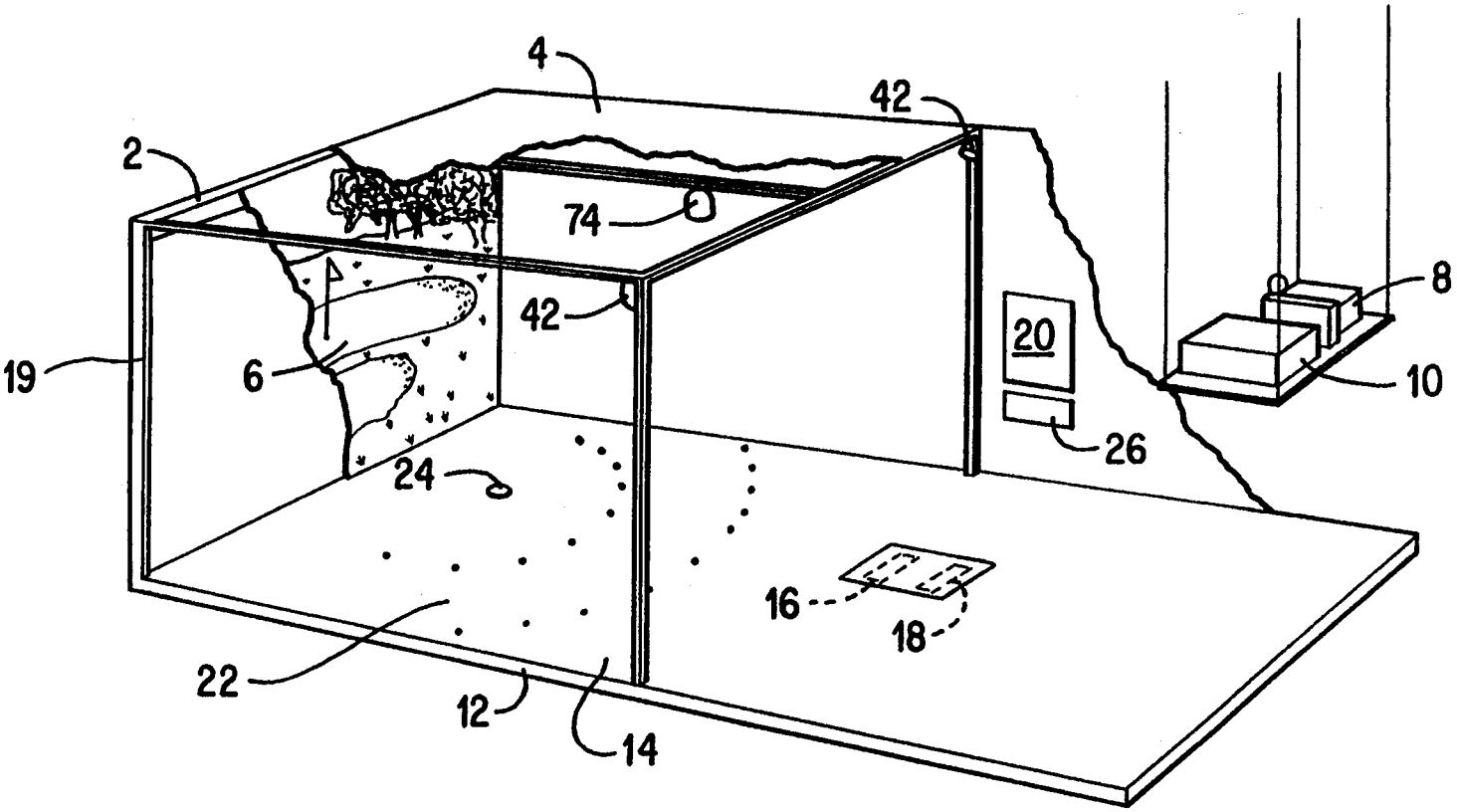
FIG. 1 is a perspective view of the golf simulator of the present invention.

FIG. 1 is a perspective illustration of the golf simulator according to the present invention. The simulator includes a self-supporting, structural steel frame 2 supporting a canopy 4. Canopy 4 is preferably formed of a fire retardant fabric. Frame 2 also supports a projection screen 6 that receives an image from a film strip projector 8 and a ball tracer 10 (described below). Screen 6 is preferably formed of an impact resistant nylon. The floor is preferably formed of a sound absorbing foam base 12 and a durable synthetic turf carpeting 14. Carpet 14 includes a hitting area 16 that covers a clubhead impact angle sensor 18 (described below). A player control panel 20 is disposed outside of canopy 4. Carpet 14 also preferably includes a putting area 22 and a regulation size cup 24.

Figure 2:
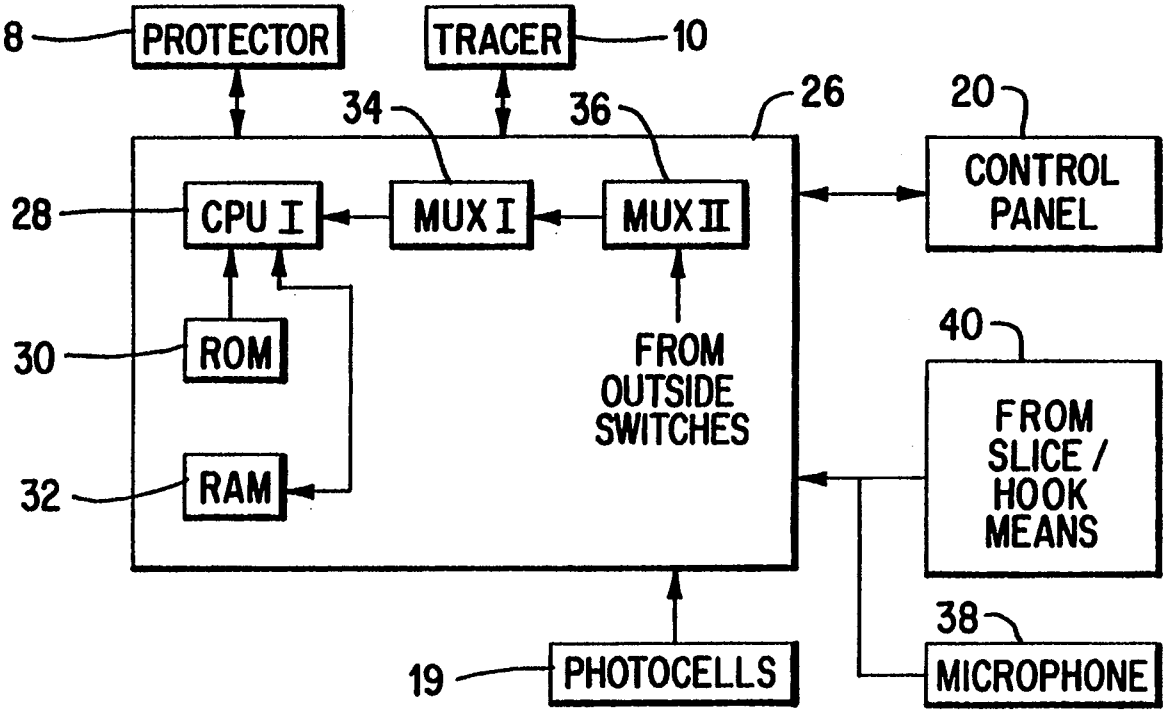
FIG. 2 is a schematic illustration of the golf simulator.

A computer control system 26 communicates and controls the entire golf simulator. Referring to FIG. 2, controller 26 includes a CPU 28, a ROM 30 and a RAM 32. Signals received from the outside sensors are sorted by a pair of multiplexers (MUX) 34, 36.

Controller 26 communicates with projector 8, tracer 10 and control panel 20 and receives signals from slice/hook determining means 40, photocells 19 and an impact sensor, such as a microphone 38.

In operation, upon power up via the control panel 20, the sensors and controller are initialized and calibrated, whereupon an advance switch is activated by a player. At this time, the CPU sends a signal to projector 8 to advance to the next tee. Hopefully, a previous user will have reset the film strip photographs so that the next tee is the first tee of the desired course. However, if a previous game was stopped or interrupted in the middle of a round, the projector will merely advance the film strip to the next tee. This is accomplished by scanning a series of notches on the side of the film. A special notch on one side of the film indicates the beginning of the next hole.

At all times before impact, after displaying an appropriate slide in accordance with the player's location, the system is continuously scanning and calibrating the sensors in a known manner.

When a player swings a golf club to impact a golf ball in the hitting area 16 of carpet 14, microphone 38 detects impact between the clubhead and the golf ball. The CPU 28 initiates a counter that measures the time until one of the seven photocells 19 has been tripped. As the distance between hitting area 16 and target screen 6 is known, the CPU can then calculate golf ball velocity and thereby can determine the travel distance of the golf ball.

In order to determine where the golf ball contacted the target screen, the CPU 28 receives signals from adjacent photocells 19 behind the target screen to the photocell first tripped and interpolates between photocells, correcting for a time differential. For example, if the golf ball impacts the target screen directly between two adjacent photocells 19, each of the two adjacent photocells will be tripped simultaneously, and the CPU will determine that the golf ball impacted the target screen directly between the two adjacent photocells. If the golf ball impacts the target screen slightly to the left or right of center between two adjacent photocells, the CPU can determine the impact point by interpolating over the time differential of when the photocells were tripped.

The CPU 28 receives the signal from photocells 19, and controller 26 controls tracer 10 to project a simulated ball flight at a proper location on the target screen. Tracer 10 includes a pair of adjustable mirrors that direct a spotlight toward the target screen at the desired location. An adjustable iris is disposed in the light path and acts to reduce the size of the spotlight (simulated ball) during the illustration of the ball trajectory. As a result, the simulated ball appears to be travelling away from the player.

After determining the travel distance of the golf ball, the CPU 28 accesses a predetermined elevation curve stored in ROM 30 corresponding to the determined distance. Controller 26 then provides the elevation component to tracer 10. Additionally, using the slice/-hook determining means 40 (described below), a slice/-hook component of the simulated ball trajectory is provided.

Controller 26 then drives projector 8 to the slide corresponding to the golf ball travel distance. The slides are taken in 10 yard intervals and extend up to about 60 yards past the green. Each slide displays the distance travelled from the tee and the distance to the cup. For example, on a 350 yard hole, if the player drives the golf ball 200 yards, the projector will move forward 20 slides and display 200 yards travelled and 150 yards to the cup. In determining which slide corresponds to the next shot, controller 26 rounds the distance travelled to the nearest 10 yards. After impact, if CPU 28 determines that the golf ball has travelled in the range of about 30–40 yards left or right of the fairway, an out-of-bounds alarm is triggered, and the player is required to re-hit the previous shot.

If the CPU 28 determines that the ball has come to rest on the green, the next slide indicates how many feet the ball is from the hole and the light emitted from tracer 10 indicates whether the ball is toward the front, back, left or right of the cup. If desired, the player can then activate the putting lights to illuminate putting area 22 and hole 24. Putting area 22 includes distance markers so that the player can putt from a distance corresponding to the distance from the hole indicated by tracer 10. If the player elects not to putt, the player can simply instruct the system to advance to the next tee on control panel 10 and prepare for the next shot.

The slice/hook determining means of the present invention will now be described in greater detail with reference to FIGS. 3–5.

Figure 4:
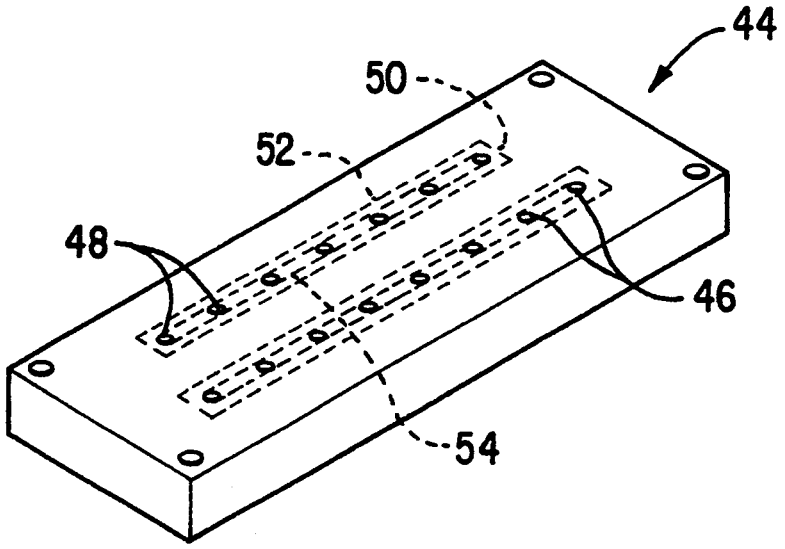
FIG. 4 is a perspective view of the clubhead impact angle sensor of the present invention.

With reference to FIG. 4, the slice/hook determining means 40 includes a clubhead impact angle sensor 44. Sensor 44 includes a first row of eight photosensors 46 and a second row of seven photosensors 48. The clubhead impact angle sensor 44 is disposed directly behind the golf ball in hitting area 16, preferably about 1–2 inches.

Sensors 46, 48 are sensitive to about 5° each side of center. In one arrangement, an elongated opaque plate (shown in phantom) 52, preferably made of a plastic material, having two narrow slits 54 is positioned over the sensors to narrow the acceptance range of the photocell to more precisely define the passing of the clubhead. Alternatively, two plates having a single slit can be used.

Figure 3:
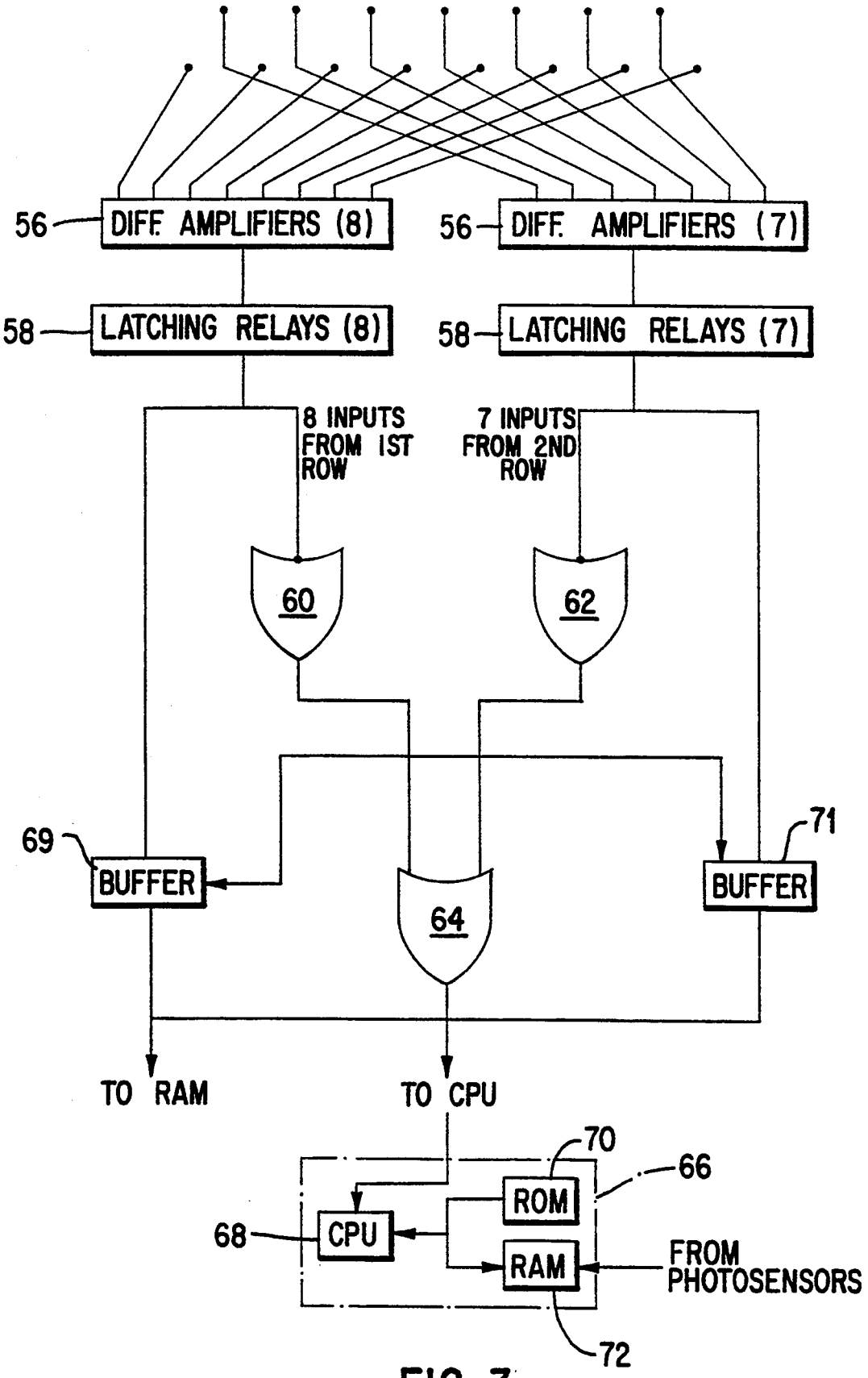
FIG. 3 is a schematic illustration of the slice/hook determining apparatus.

Referring to FIG. 3, each of the sensors 46, 48 is electrically coupled to a differential amplifier 56 for amplifying an interruption signal. Each differential amplifier 56 is in turn connected to an electronic latching relay 58. Input from the eight sensors 46 in the first row is received by an eight input NOR gate 60, and input from the seven sensors 48 in the second row is received by a second eight input NOR gate 62. Outputs from NOR gates 60 and 62 are received by a third NOR gate 64, which sends an ON signal to CPU 68 of controller 66 of the slice/hook determining means (S1). This arrangement initiates the slice/hook determining operation upon dynamic interruption of any of the 15 sensors 46, 48. If CPU 28 determines that the golf ball travel distance is less than a predetermined distance, the slice/-hook operation is not carried out. This distance is preferably about 0–130 yards, and most preferably about 100 yards.

Figure 5:
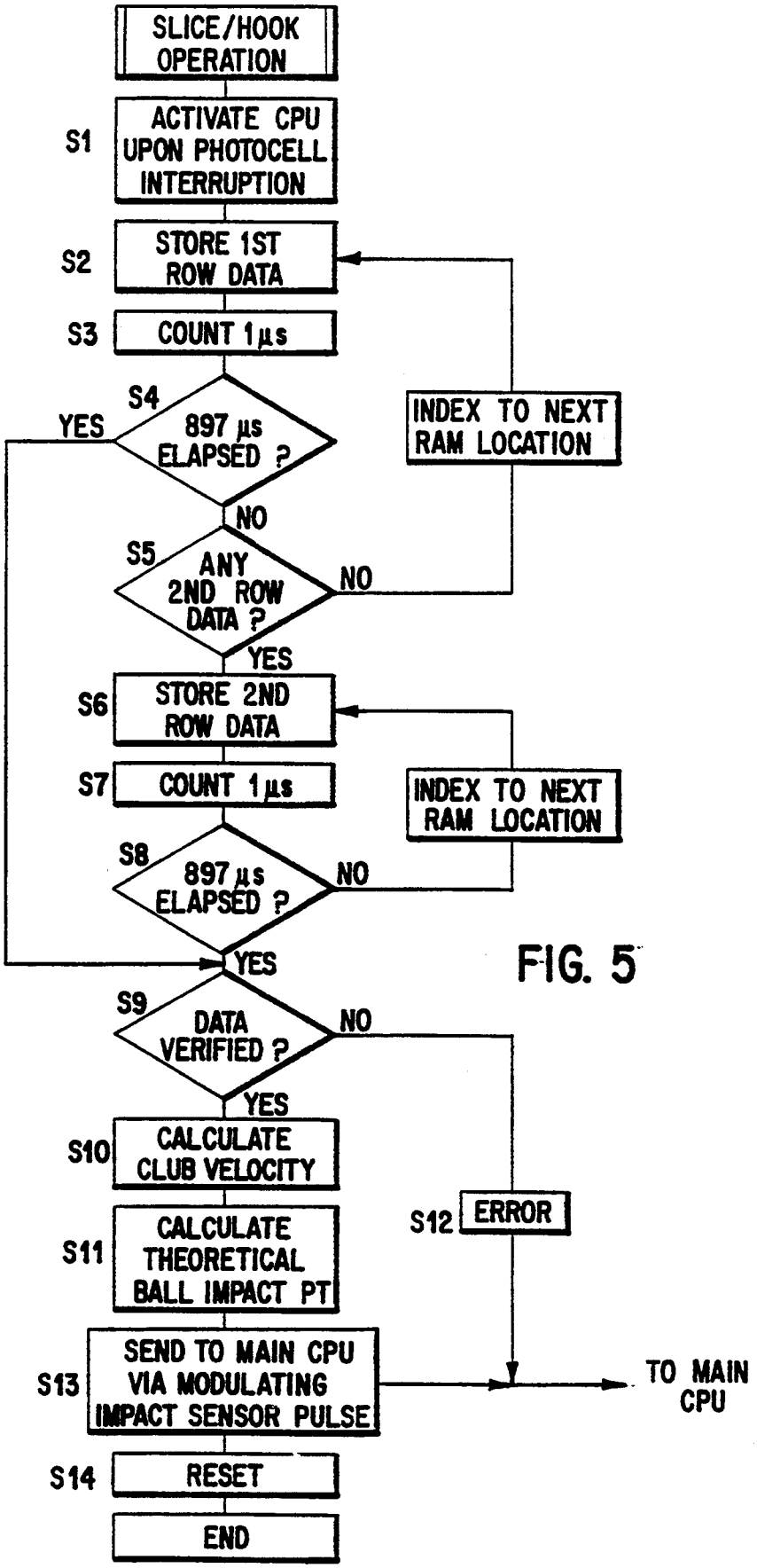
FIG. 5 is a flowchart illustrating the slice/hook operation of the invention.

Referring to FIGS. 3 and 5, as the photocells are interrupted, CPU 68 is activated (discussed above) and first row photocell interruption data is stored in RAM 72 through a first buffer 69. Data is stored in 1 microsecond intervals for preferably about 897 microseconds (S2–S4). Upon interruption of a photocell in the second row (S5), NOR gate 62 deactivates first buffer 69 and activates a second buffer 71, through which second row photocell interruption data are stored in RAM 72 (S6). Data storage continues in 1 microsecond intervals until the expiration of the about 897 microseconds (S7–S8). The data stored in RAM 72 defines a profile of the clubhead path through impact.

The validity of the stored data is determined by CPU 68 in accordance with predetermined acceptable data windows such as existence of second row data, time between first and second row interruption, perceived clubhead size, blocked or failed photocell, etc., (S9). If the data is determined to be invalid, an error signal is sent (S12).

Beginning at the 898th microsecond, CPU 68 begins calculations, reviewing data stored in RAM 72. The velocity of the clubhead is determined (S10) by interpolating the time between adjacent sensors triggered in the first row and comparing that time with a time elapsed to trigger the sensor in the second row disposed between the adjacent sensors in the first row. The distance between sensors 46 and sensors 48 is then divided by this time to determined clubhead velocity. After determining clubhead velocity, the clubhead impact angle can be determined from the time between triggering adjacent sensors in the first row.

Using this information, CPU 68 can determine the theoretical ball impact with the target screen (S11), which is a straight line from the triggered sensors to the target screen adjusted for clubhead impact angle (i.e., the impact point on the target screen if no slice or hook is imparted to the ball).

The impact sensor (such as a microphone) generates a 32 ms pulsewidth at impact. The theoretical ball impact point determined by CPU 68 is sent to main CPU 28 by modulating the height of the impact sensor pulsewidth (S13), and the slice/hook determining means is reset (S14). The theoretical impact point is then compared with the actual impact point indicated by photocells 19.

It has been determined that, for a right handed player, if the actual impact point is left of the theoretical impact point, a slicing spin has been imparted to the ball; and if the actual impact point is right of the theoretical impact point, a hooking spin has been imparted to the ball.

Using this information, CPU 28 accesses a predetermined spin trajectory that is scaled in accordance with the distance left or right of the theoretical impact point. Controller 26 then controls tracer 10 accordingly.

In order to prevent the shadow of the golf club shaft from triggering photosensors 46, 48, a light 74 (FIG. 1) is placed above hitting area 16 and shifted a predetermined distance toward target screen 6. Preferably, light 74 is shifted about 0°–30° from directly above the hitting area and most preferably about 9.5°. The described slice/hook determining means thereby provides an accurate representation of the ball trajectory incorporating a slice/hook component.

While the embodiments disclosed herein are preferred, it will be appreciated from this teaching that various alternatives, modifications, variations or improvements therein may be made by those skilled in the art that are within the scope of the invention, which is defined by the following claims.

For example, the projector projecting the golf course image on the target screen and the tracer projecting the ball flight on the target screen may suitably be replaced with a single video projector. As a result, precise alignment of the projector and the tracer is not required.

What is claimed is:

1. A golf simulator having a frame supporting a target screen, the golf simulator operating in accordance with impact between a clubhead and a golf ball, the golf simulator comprising:

a projector for projecting a golf course image on said target screen;

a tracer for projecting a ball image on said course image on said target screen, said tracer comprising means for dynamically illustrating a ball trajectory; and a controller for determining said ball trajectory in accordance said impact and for controlling said tracer in accordance with said determined ball trajectory, said controller comprising a data processor for determining a simulated golf ball travel distance, a screen impact sensor for sensing an actual impact point on said target screen, and a slice/hook determining means for determining a theoretical impact point on said target screen, wherein a slice/hook component of said ball trajectory is determined in accordance with a comparison between said theoretical impact point and said actual impact point.

2. A golf simulator according to claim 1, further comprising an impact sensor for sensing the impact between the clubhead and the golf ball, and wherein said slice/hook determining means comprises a clubhead impact angle sensor for sensing an angle of the clubhead at impact with said golf ball, wherein said data processor determines said golf ball travel distance in accordance with data obtained from said impact sensor and a distance between said golf ball at impact and the target screen, and wherein said slice/hook determining means determines said theoretical impact point in accordance with data obtained from both said clubhead impact angle sensor and said distance between said golf ball at impact and the target screen.

3. A golf simulator according to claim 2, further comprising a timer for determining a time between impact of the clubhead and the golf ball sensed by said impact sensor and impact of the golf ball and said target screen sensed by said screen impact sensor, wherein said data processor determines said golf ball travel distance further in accordance with data obtained from said timer.

4. A golf simulator according to claim 2, wherein said clubhead impact angle sensor comprises a first row of photosensors and a second row of photosensors, said first and second rows being substantially parallel to said target screen and spaced from each other by a predetermined distance, said photosensors being in communication with said data processor, wherein upon interruption of one of said photosensors, data from said photosensors is provided to said data processor at predetermined intervals of time for a predetermined period of time, thereby defining a profile of the clubhead path.

5. A golf simulator according to claim 4, wherein said predetermined intervals of time are about 1 μs.

6. A golf simulator according to claim 5, wherein said predetermined period of time is about 897 μs.

7. A golf simulator according to claim 4, wherein said first row of photosensors comprises eight photosensors and said second row of photosensors comprises seven photosensors, said second row of photosensors being laterally offset from said first row of photosensors.

8. A golf simulator according to claim 7, wherein said clubhead impact angle sensor further comprises means for limiting a sensing range of said photosensors.

9. A golf simulator according to claim 8, wherein said limiting means comprises at least one plate member having at least one longitudinal slit therein, said slit having a width that is narrower than a width of said photosensors.

10. A golf simulator according to claim 4, further comprising a light disposed above and in front of said photosensors.

11. A golf simulator according to claim 1, wherein said data processing device determines said slice/hook component of said ball trajectory based on a predetermined spin trajectory that is scaled in accordance with the difference between said theoretical impact point and said actual impact point.

12. A controller operating in accordance with impact between a clubhead and a golf ball for determining a golf ball trajectory and for controlling means for illustrating said golf ball trajectory, said controller comprising:

a screen impact sensor for sensing an actual impact point on said target screen; and slice/hook determining means for determining a theoretical impact point on said target screen, wherein a slice/hook component of said ball trajectory is determined in accordance with a comparison between said theoretical impact point and said actual impact point.

13. A controller according to claim 12, further comprising an impact sensor for sensing impact between the clubhead and the golf ball, wherein said slice/hook determining means comprises a clubhead impact angle sensor for sensing an angle of the clubhead at impact with said golf ball, and wherein said slice/hook determining means determines said theoretical impact point in accordance with data obtained from both said clubhead impact angle sensor and a distance between said golf ball at impact and the target screen.

14. A controller according to claim 13, wherein said clubhead impact angle sensor comprises a first row of photosensors and a second row of photosensors, said first and second rows being substantially parallel to said target screen and spaced from each other by a predetermined distance, said photosensors being in communication with said slice/hook determining means, wherein upon interruption of one of said photosensors, data from said photosensors is provided to said slice/hook determining means at predetermined intervals of time for a predetermined period of time, thereby defining a profile of the clubhead path.

15. A controller according to claim 14, wherein said predetermined intervals of time are about 1 μs.

16. A controller according to claim 15, wherein said predetermined period of time is about 897 μs.

17. A controller according to claim 14, wherein said first row of photosensors comprises eight photosensors and said second row of photosensors comprises seven photosensors, said second row of photosensors being laterally offset from said first row of photosensors.

18. A controller according to claim 17, wherein said clubhead impact angle sensor further comprises means for limiting a sensing range of said photosensors.

19. A controller according to claim 18, wherein said limiting means comprises at least one plate member having at least one longitudinal slit therein, said slit having a width that is narrower than a width of said photosensors.

20. A controller according to claim 12, wherein said slice/hook determining means is connected to a data processing device, said data processing device determining said slice/hook component of said ball trajectory based on a predetermined spin trajectory that is scaled in accordance with the difference between said theoretical impact point and said actual impact point.

21. An apparatus for determining a slice/hook component of a golf ball trajectory of a ball displaced by a clubhead from a hitting area to a target screen, the apparatus comprising:

clubhead impact angle sensing means for sensing a clubhead impact angle;

means for determining a theoretical impact point on said target screen in accordance with said clubhead impact angle;

sensing means for sensing an actual impact point on said target screen;

comparing means for comparing said theoretical impact point and said actual impact point; and data processing means for determining said slice/hook component of said ball trajectory based on a predetermined spin trajectory that is scaled in accordance with the difference between said theoretical impact point and said actual impact point.

22. An apparatus according to claim 21, wherein said clubhead impact angle sensing means comprises a first row of photosensors and a second row of photosensors, said first and second rows being substantially parallel to said target screen and spaced from each other by a predetermined distance, said photosensors being in communication with said theoretical impact point determining means, wherein upon interruption of one of said photosensors, data from said photosensors is provided to said theoretical impact point determining means at predetermined intervals of time for a predetermined period of time, thereby defining a profile of the clubhead path.

23. A golf simulator according to claim 22, wherein said predetermined intervals of time are about 1 μs.

24. A golf simulator according to claim 23, wherein said predetermined period of time is about 897 μs.

25. A golf simulator according to claim 22, wherein said first row of photosensors comprises eight photosensors and said second row of photosensors comprises seven photosensors, said second row of photosensors being laterally offset from said first row of photosensors.

26. A golf simulator according to claim 25, wherein said clubhead impact angle sensor further comprises means for limiting a sensing range of said photosensors.

27. A golf simulator according to claim 26, wherein said limiting means comprises at least one plate member having at least one longitudinal slit therein, said slit having a width that is narrower than a width of said photosensors.

28. A method of determining a slice/hook component of a golf ball trajectory of a ball displaced by a clubhead from a hitting area to a target screen, the method comprising the steps of:

sensing a clubhead impact angle;

determining a theoretical impact point on said target screen in accordance with said clubhead impact angle;

sensing an actual impact point on said target screen;

comparing said theoretical impact point and said actual impact point; and determining said slice/hook component of said ball trajectory based on the difference between said theoretical impact point and said actual impact point.

* * * * *